US005492106A

United States Patent [19]

Sharma et al.

[11] Patent Number: 5,492,106

[45] Date of Patent: Feb. 20, 1996

[54] JUMP-HOLD FUEL CONTROL SYSTEM

[75] Inventors: Vipon K. Sharma, W. Bloomfield; Dave G. Farmer, Plymouth; Shailesh N. Patel, Garden City, all of Mich.

[73] Assignee: Ford Motor Company, Dearborn, Mich.

[21] Appl. No.: 363,856

[22] Filed: Dec. 27, 1994

[51] Int. Cl.[6] ..... F02D 41/14

[52] U.S. Cl. ..... 123/681; 123/687

[58] Field of Search ..... 123/679, 681, 123/682, 687, 696

[56] References Cited

U.S. PATENT DOCUMENTS

| | | | |
|---|---|---|---|
| 4,121,554 | 10/1978 | Sueishi et al. | 123/679 |
| 4,143,623 | 5/1979 | Norimatsu et al. | 123/682 |
| 4,690,121 | 9/1987 | Kawanabe et al. | 123/681 |
| 4,858,581 | 8/1989 | Hosoi et al. | 13/687 |
| 4,905,650 | 3/1990 | Mausner | 123/681 |
| 5,050,560 | 9/1991 | Plapp | 123/681 |
| 5,220,904 | 6/1993 | Miyashita et al. | 123/687 |
| 5,249,130 | 9/1993 | Mamiya et al. | 123/681 |
| 5,291,873 | 3/1994 | Hirschmann et al. | 123/682 |
| 5,375,583 | 12/1994 | Meyer et al. | 123/681 |

OTHER PUBLICATIONS

Hideaki Katashiba et al., "Fuel Injection Control Systems that Improve Three Way Catalyst Conversion Efficiency," SAE International, International Congress and Exposition, Feb. 25–Mar. 1, 1991.

Douglas R. Hamburg et al., "A Closed–Loop A/F Control Model for Internal Combustion Engines," Society of Automotive Engineers, Inc. Passenger Car Meeting, Jun. 9–13, 1980.

*Primary Examiner*—Willis R. Wolfe
*Attorney, Agent, or Firm*—Peter Abolins; Roger L. May

[57] ABSTRACT

An Electronic Engine Controller (EEC) is calibratable to control the rate at which fuel is delivered to an intake of an internal combustion engine in order to achieve a bias in the air/fuel ratio combusted by the engine. The EEC operates under closed-loop control to alter the fuel delivery rate in response to an output of an oxygen sensor which detects the concentration in exhaust gas produced by the engine. The EEC achieves a predetermined bias, in the air/fuel ratio, which is in a rich or lean direction from stoichiometry, by maintaining the fuel delivery rate at a jump value upon the indication by the oxygen sensor of an air/fuel ratio in the same direction from stoichiometry as the desired bias. The fuel delivery rate is maintained at the jump value for a variable period of time, which preferably depends upon the engine speed and load. Upon expiration of the variable period of time, the fuel delivery rate is abruptly altered to a fuel delivery rate corresponding to a predetermined air/fuel ratio. The fuel delivery rate is thereafter progressively altered until the indication by the oxygen sensor of an air/fuel ratio in the same direction from stoichiometry as the desired bias.

17 Claims, 8 Drawing Sheets

JUMP-HOLD FUEL CONTROL SYSTEM

FIELD OF THE INVENTION

This invention relates to methods and apparatus for controlling the air/fuel ratio of a fuel mixture delivered to an internal combustion engine.

BACKGROUND OF THE INVENTION

Electronic engine controllers (EEC) typically utilize a closed-loop form of control to maintain the ratio of air and fuel in an air/fuel mixture combusted by the engine at or near stoichiometry. Under closed-loop control, the amount of fuel delivered is determined primarily by the concentration of oxygen in the exhaust gas. The oxygen concentration being indicative of the ratio of air and fuel that has been ignited. Typically, an oxygen sensor detects the concentration of oxygen in the exhaust gas and transmits a representative signal to the EEC which determines a fuel flow rate in response to the detected oxygen concentration.

Modern automotive engines utilize a three-way catalytic converter to reduce the unwanted by-products of combustion. Typically, closed-loop air/fuel control systems control the fuel flow rate to cause an oscillation of the air/fuel mixture about stoichiometry in an attempt to maximize catalytic converter efficiency. A number of variables affect converter efficiency including the average ratio of air to fuel combusted by the engine, the limit cycle frequency of the fuel delivery rate and the peak to peak amplitude of the fuel delivery rate.

Sometimes, in order to achieve peak converter efficiency, it is desirable to bias the ratio of air and fuel to be either rich or lean of stoichiometry. For instance, the use of fuels other than gasoline, such as methanol, natural gas or liquid propane, can cause an oxygen sensor to transmit a signal which indicates an oxygen content which is offset from the actual oxygen content of the detected oxygen gas. In such an instance it is desirable to calibrate the engine to compensate for the offset.

Known engine controllers are limited in the manner in which they can be calibrated in order to achieve maximum catalytic converter efficiency. Consequently, either the engine hardware, such as an oxygen sensor in the case of the use of alternative fuels, must be modified to meet the specifications of the engine controller, or the engine controller must be redesigned to meet the specifications of the different fuel type or different hardware. This limitation causes increased vehicle design costs and limits the component complexity.

SUMMARY OF THE INVENTION

It is an object of the present invention to provide an electronic engine controller which determines a fuel flow rate in a accordance with parameters which may be optimized to achieve improved catalyst efficiency.

In accordance with the primary object of the invention, in an internal combustion engine, which combusts an air/fuel mixture to generate an exhaust gas, the fuel delivery rate at which fuel is supplied to the fuel intake of the engine is determined in a manner to bias the average air/fuel mixture combusted by the engine by a variable amount in a first direction from stoichiometry, by measuring the amount of oxygen in the combustion gases exhausted by the engine to produce a first exhaust indication when the oxygen level indicates a ratio of air to fuel in the air/fuel mixture which is in the first direction from stoichiometry and to produce a second exhaust indication when the oxygen level indicates a ratio of air to fuel in the air/fuel mixture gas which is in a second direction from stoichiometry, the second direction being opposite from the first direction. The engine controller responds to the first exhaust indication by (1) abruptly altering the fuel delivery rate to a rate which produces a ratio of air to fuel in the air/fuel mixture which is equal to a predetermined air/fuel ratio, and (2) thereafter progressively altering the fuel delivery rate to gradually change the ratio of air to fuel in the air/fuel mixture in the second direction from stoichiometry. The engine controller responds to the second exhaust indication by (1) altering the fuel delivery rate by a jump value, (2) maintaining the fuel delivery rate for a hold time, (3) abruptly altering the fuel delivery rate to a rate which produces a ratio of air to fuel in the air/fuel mixture which is substantially equal to said predetermined air/fuel ratio, and (4) thereafter progressively altering the fuel delivery rate to gradually change the ratio of air to fuel in the air/fuel mixture in the first direction from stoichiometry.

An advantage of certain preferred embodiments is that biases or offsets inherent in the oxygen content detected by an exhaust gas oxygen sensor may be achieved, without changing engine hardware, by calibrating the fuel flow rate to the fuel intake of the engine in a manner which is consistent with the bias of the oxygen sensor. Thus, improved catalytic conversion efficiency can be achieved for a variety of different engines, which may use different fuels, without modifications to engine hardware.

These and other features and advantages of the present invention may be better understood by considering the following detailed description of a preferred embodiment of the invention. In the course of this description, reference will frequently be made to the attached drawings.

DETAILED DESCRIPTION

Figure 1:
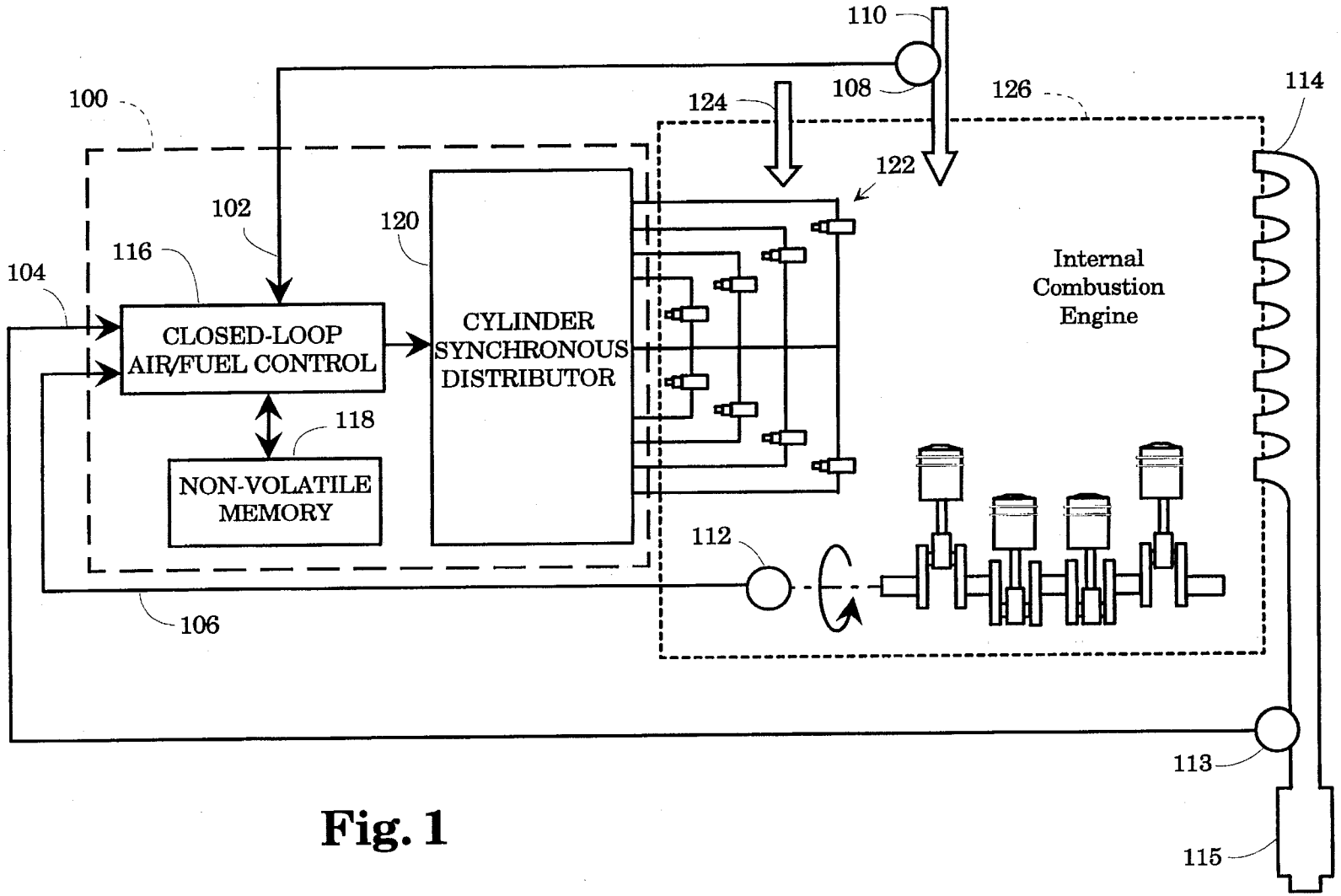
FIG. 1 of the drawings shows a schematic diagram of a preferred embodiment of portions of an internal combustion engine and a electronic engine controller which utilizes the principles of the invention.

FIG. 1 of the drawings shows a system which embodies the principles of the invention. A proportional+integral (PI) controller 100 has three signal inputs 102, 104, and 106. Signal input 102 is produced by a mass air flow sensor 108 which generates a voltage proportional to the mass of air being delivered to the engine through an air intake manifold 110. Signal 106 is obtained from a transducer 112 which generates a series of timing impulses as the crankshaft turns. These timing pulses may be processed as discussed below to provide an indication of crankshaft and piston positions, as well as the engine's rotational velocity (rpm). Input signal 104 is produced by Heated Exhaust Gas Oxygen sensor (HEGO) 113 which generates a voltage that is a function of the concentration of oxygen or A/F in the exhaust manifold 114. This voltage is used as an input to a voltage comparator (not shown) to detect whether the exhaust air fuel ratio is rich or lean of stoichiometry. Cylinder synchronous fuel control signal distributor 120 seen in FIG. 1 generates a control signal to which each injector responds, and then schedules the fuel for the next injection. The actual fuel injection occurs in response to a PIP interrupt signal derived from the tachometer 112, which causes a hardware forced branch to routines shown in FIGS. 3–6.

The PI controller 100 consists of three modules: a closed-loop air/fuel control system 116; a nonvolatile memory 118 for storing adaptively generated values; and a cylinder synchronous signal distributor 120. These modules, all of which are preferably implemented by a micro-controller operating under stored program control, produce control signals which are applied to actuate the fuel injectors indicated generally at 122 in FIG. 1. Each of the fuel injectors 122 is operatively connected to a fuel supply conduit indicated at 124 and physically integrated with an internal combustion engine depicted within the dotted rectangle 126. Each of the fuel injectors 122 is of conventional design and is positioned to inject fuel into its associated cylinder in precise quantities at precise times synchronized with engine motion by the impulses from transducer 112. These impulses which may be applied as interrupt signals, called PIPS (Profile Ignition PickupS), which are typically applied to the microprocessor's interrupt terminal (not shown). The microprocessor then responds by executing interrupt handling routines which perform time-critical operations under the control of variables stored in memory.

Figure 2A:
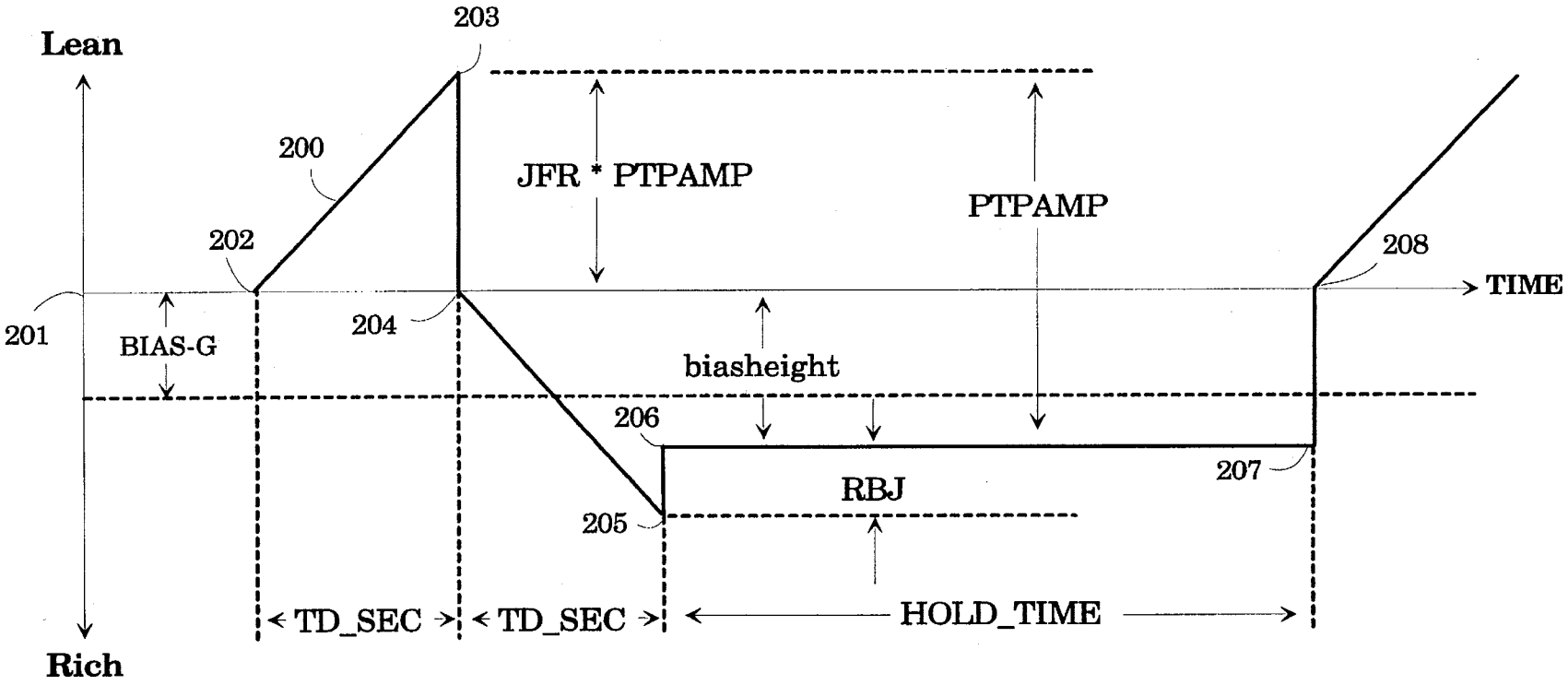
FIGS. 2(*a*), 2(*b*) and 2(*c*) are graphs showing the response of a preferred embodiment to different sensed conditions.
Figure 2B:
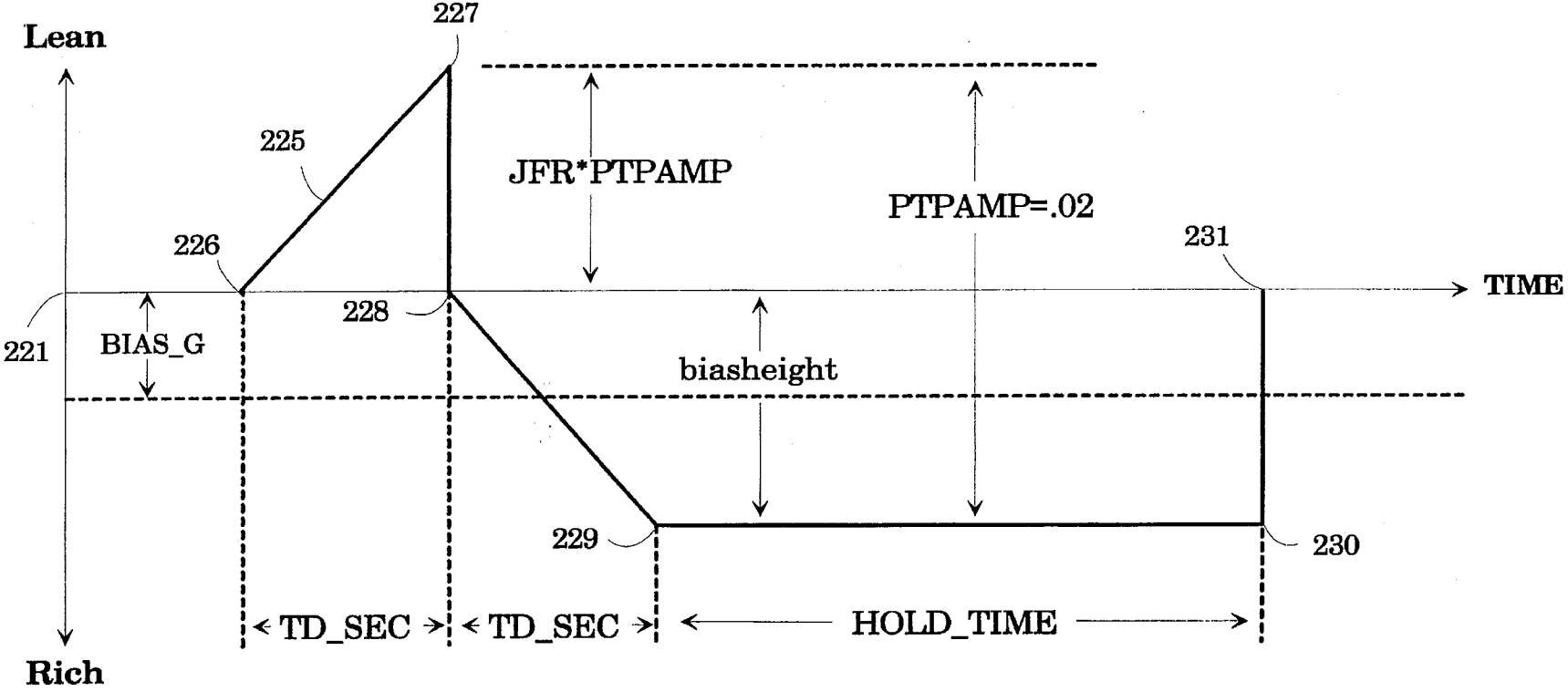
Figure 2C:
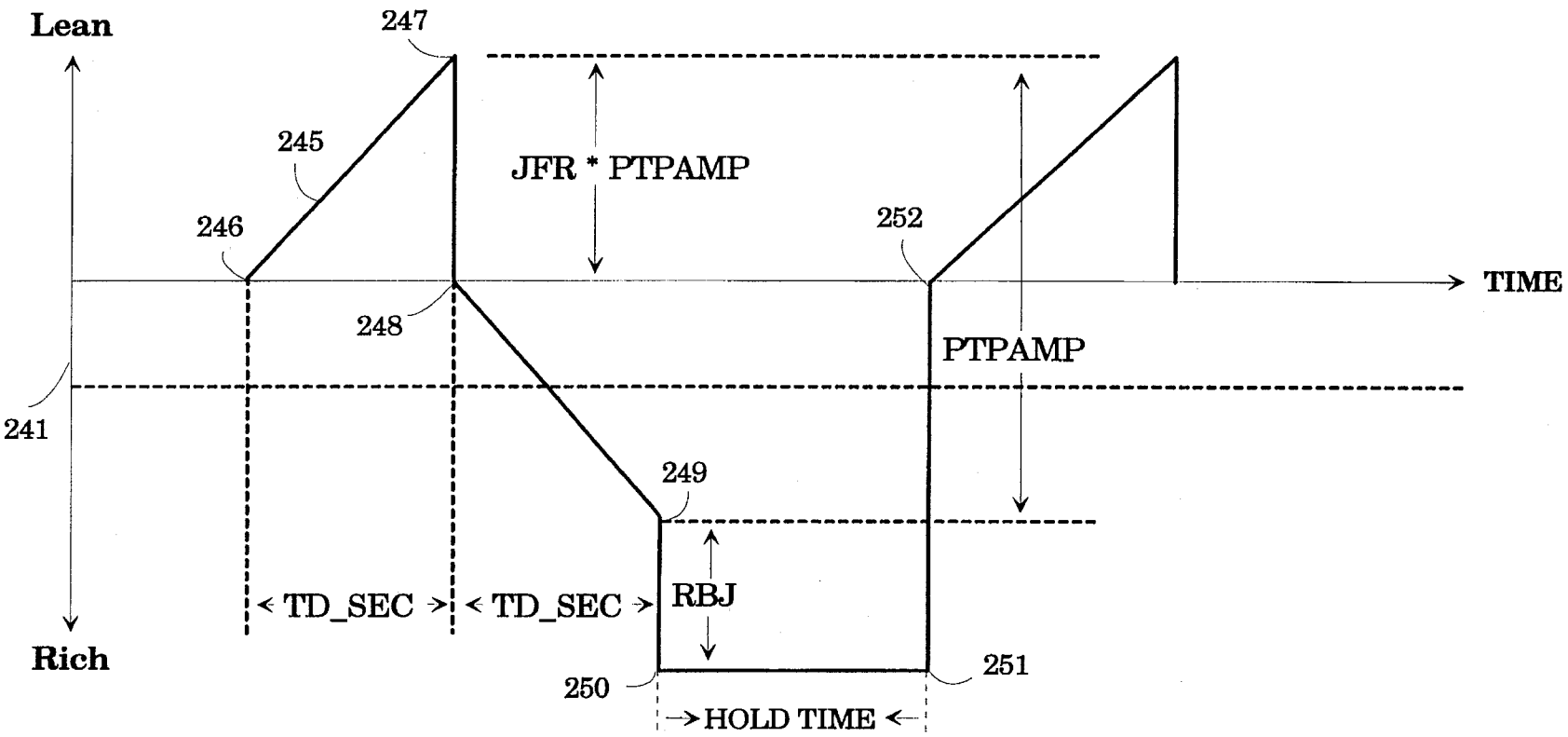

FIGS. 2(*a*), 2(*b*) and 2(*c*) are graphs showing the operation of a preferred embodiment in response to different sensed conditions. In FIGS. 2(*a*), 2(*b*) and 2(*c*) the oxygen sensor transmits a signal indicative of an oxygen concentration in the exhaust gas which is leaner than the actual oxygen concentration, and the engine controller responds in a manner to compensate for the offset. In each of FIGS. 2(*a*), 2(*b*) and 2(*c*), the horizontal axis represents time and the vertical axis represents air/fuel (A/F) ratio with the horizontal axis at points 201,221 and 241 representing an A/F ratio of stoichiometry, i.e. 14.64, and with the portion of the vertical axis above points 201,221 and 241 representing a sensed A/F composition which is rich of stoichiometry and with the portion of the vertical axis below points 201,221 and 241 representing a sensed A/F composition which is lean of stoichiometry. Solid lines 200,225 and 245 show a control signal (LAMBSE) generated by the EEC which is inversely proportional in amplitude to the amount of fuel injected, typically by controlling the pulse width of the injection signals delivered to the injectors 122.

In FIGS. 2(*a*), 2(*b*) and 2(*c*), the signal range indicated by the variable PTPAMP is indicative of a predetermined peak-to-peak amplitude of the control signal LAMB SE. The signal range indicated by JFR*PTPAMP is equal to one-half of the peak-to-peak amplitude of LAMBSE (if JFR=0.5), and the value TD_SEC is a predetermined required time period for which LAMBSE is progressively altered. TD_SEC is indicative of the transport delay incurred from the time the air/fuel ratio is combusted to the time the exhaust gas from the combusted air/fuel ratio reaches the oxygen sensor. The value RBJ in FIGS. 2(*a*) and 2(*c*) is a jump value which is indicative of an amount by which LAMBSE is altered and then maintained for a period of time designated by the variable HOLD_TIME which is calculated in a manner to be explained. The signal range indicated by the variable biasheight indicates a difference in the fuel flow rate for the period of time indicated by HOLD_TIME and the fuel flow rate required to achieve a stoichiometric air/fuel ratio. Finally, the signal range indicated by the variable BIAS_G indicates a calibratable average air/fuel mixture.

FIG. 2(*a*) shows the response of a preferred embodiment to an engine which is generating acceptable hydrocarbon (HC) and carbon monoxide (CO) emissions but which is generating levels of Nox emissions which require a reduction. As can be seen in FIG. 2(*a*), from points 202 to 203, the controller 116 responds to a rich exhaust gas composition indication by steadily decreasing the fuel delivery rate, to achieve an air/fuel ratio which progressively moves in a direction away from stoichiometry, which in this case is lean of stoichiometry. At point 203, the controller responds to a lean indication by the sensor 113 by commanding the fuel injectors to immediately "jump back" to achieve an A/F mixture having a stoichiometric ratio. Thereafter, from point 204 to point 205, the controller steadily increases the fuel delivery rate, to achieve an air/fuel ratio which progressively moves in a direction away from stoichiometry-which in this case is rich of stoichiometry, until a rich indication at point 205. At 205, the fuel delivery rate is abruptly decreased by the jump value RBJ. The fuel delivery rate is then maintained for a period of time designated by the variable HOLD_TIME. At point 207, upon the expiration of the hold time, the fuel delivery rate is abruptly decreased to generate an A/F mixture having a stoichiometric ratio. Thereafter, the cycle started at point 202 is repeated.

FIG. 2(*b*) shows the response of a preferred embodiment to an engine which is generating acceptable Nox emissions but which is generating levels of hydrocarbon (HC) and carbon monoxide (CO) emissions which require a reduction. As can be seen in FIG. 2(*b*), from points 226 to 227, the controller 116 responds to a rich exhaust gas composition indication by steadily decreasing the fuel delivery rate. At point 227, the controller responds to a lean indication by the sensor 113 by commanding the fuel injectors to immediately "jump back" to an A/F mixture having a stoichiometric ratio. Thereafter, from point 228 to point 229, the controller steadily increases the fuel delivery rate until a rich indication at point 229. The fuel delivery rate is then maintained for a period of time designated by variable HOLD_TIME. At point 230, upon the expiration of the hold time, the fuel delivery rate is abruptly decreased to generate an A/F mixture having a stoichiometric ratio. Thereafter, the cycle started at point 226 is repeated.

FIG. 2(*c*) shows the response of a preferred embodiment to an engine which utilizes "alternative" fuels such as methanol, natural gas or liquid propane. As will be appreciated by those skilled in the art in view of the present disclosure, such "alternative fuels" can cause the oxygen sensor 113 to deliver an indication which is biased in a lean direction from stoichiometry. The response shown in FIG. 2(*a*) advantageously provides a rich bias to account for the bias caused by the "alternative fuel". As can be seen in FIG. 2(*c*), the controller responds in a manner similar to that shown in FIG. 2(*a*), until point 249. At point 249, in response to a rich indication, the fuel delivery rate is abruptly increased by the jump value RBJ. The fuel delivery rate is then maintained for a period of time designated by variable HOLD_TIME. At point 251, upon the expiration of the hold time, the fuel delivery rate is abruptly decreased to generate an A/F mixture having a stoichiometric ratio. Thereafter, the cycle started at point 246 is repeated.

FIGS. 2(*a*), 2(*b*) and 2(*c*) illustrate the operation of a system which has been calibrated to have a rich bias. Those skilled in the art will appreciate that similar principles may be utilized in a system in which a lean bias is desired.

Figure 3:
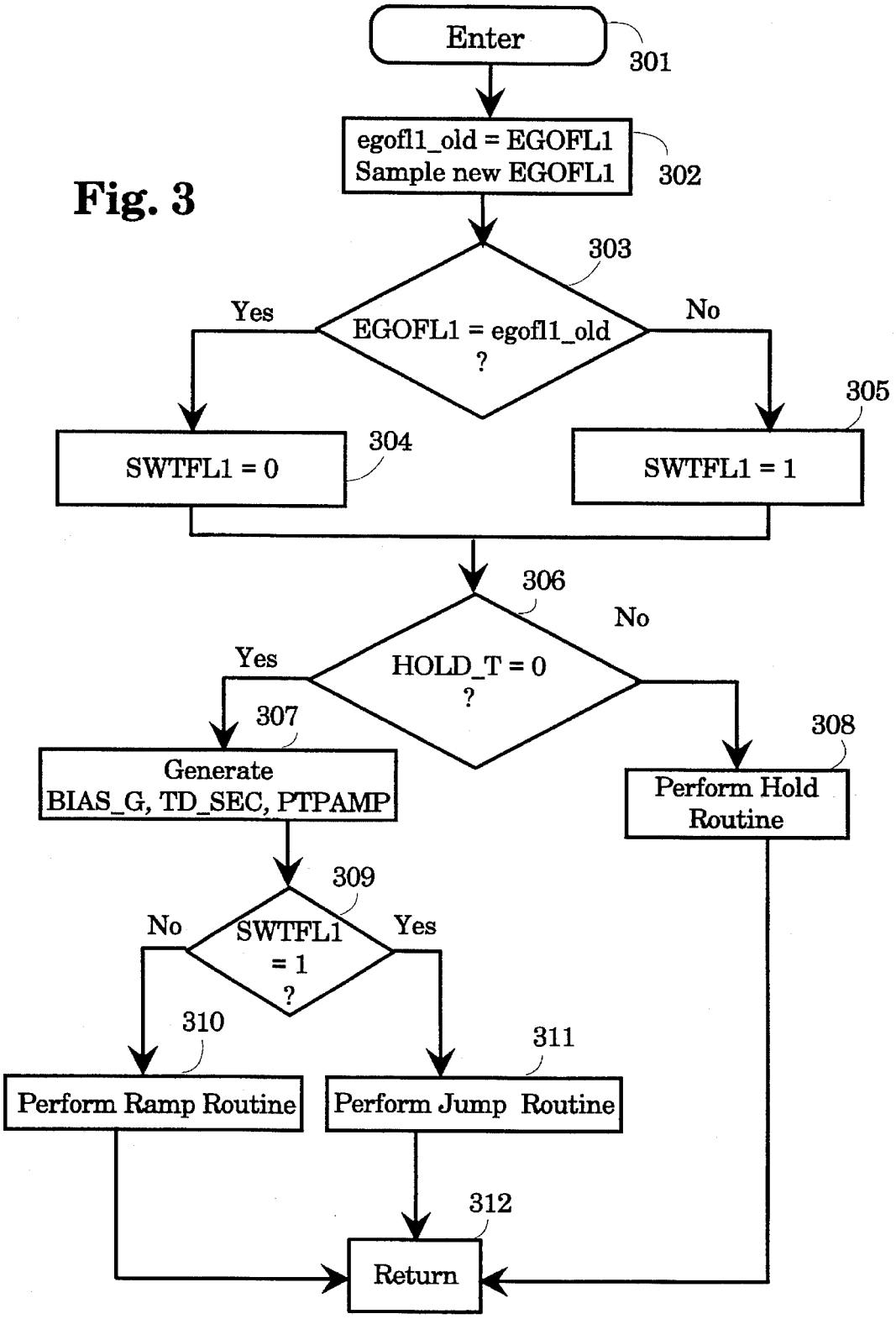
FIGS. 3, 4, 5 and 6 are flowcharts showing the steps performed by a preferred embodiment.
Figure 4:
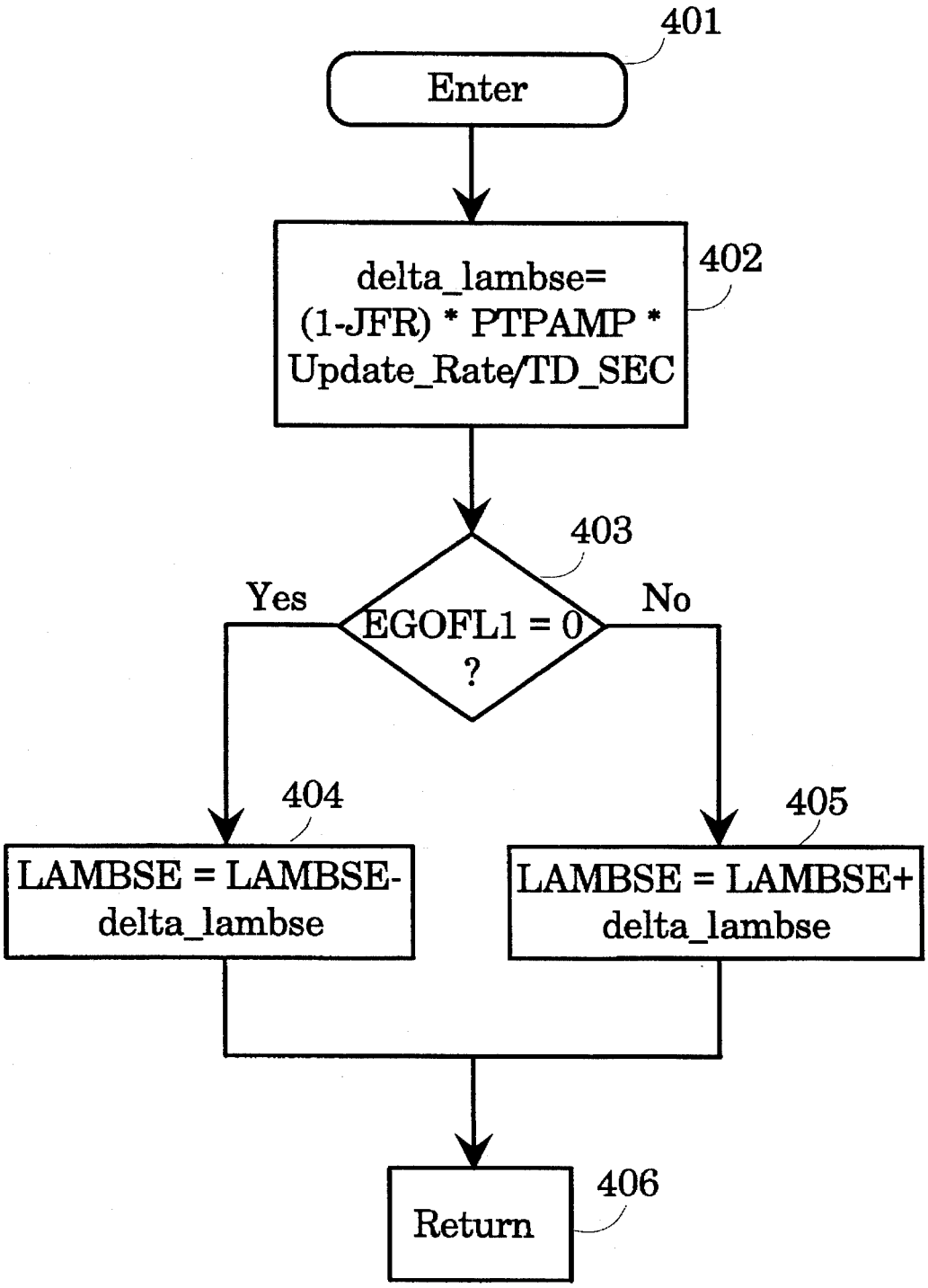
Figure 5:
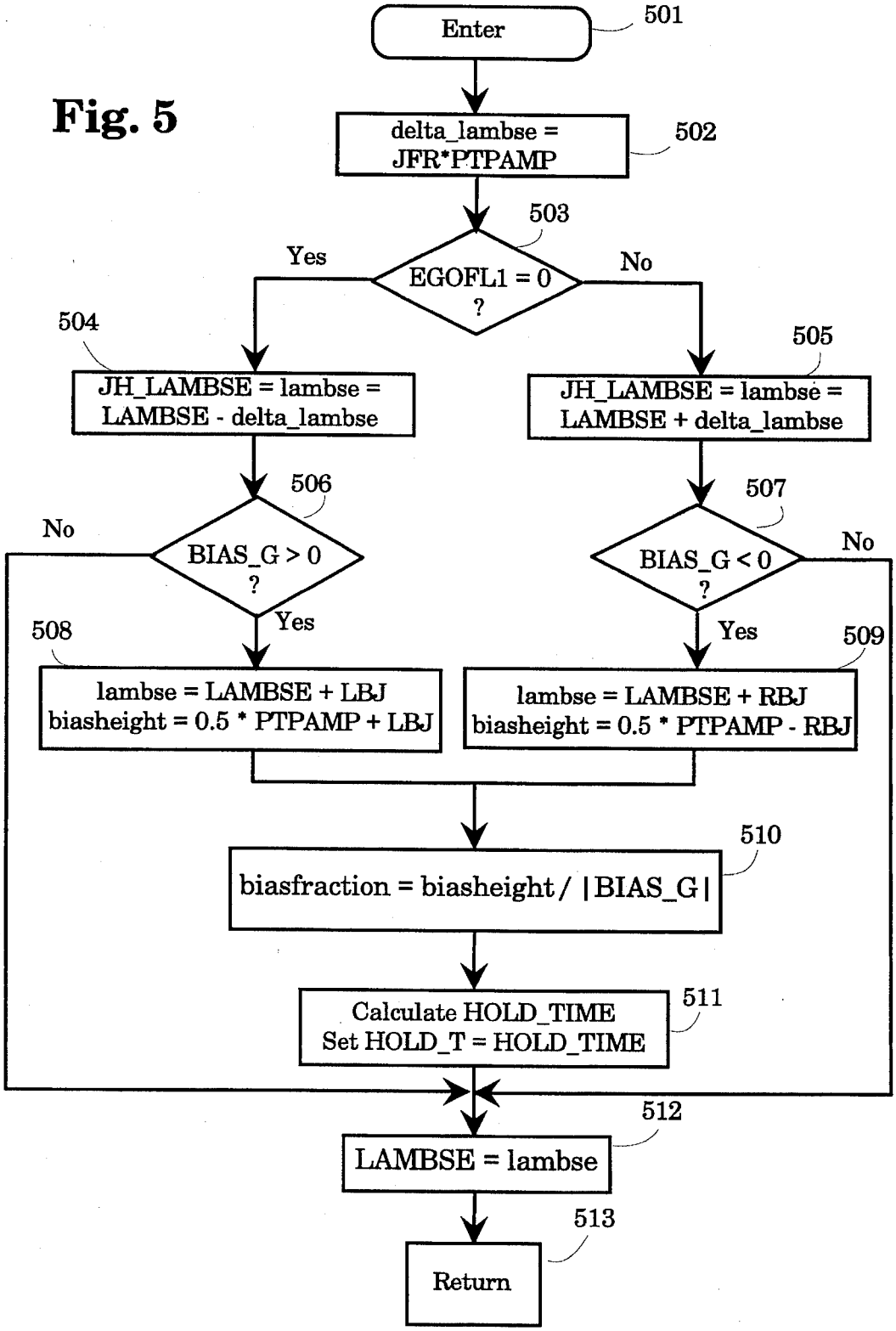
Figure 6:
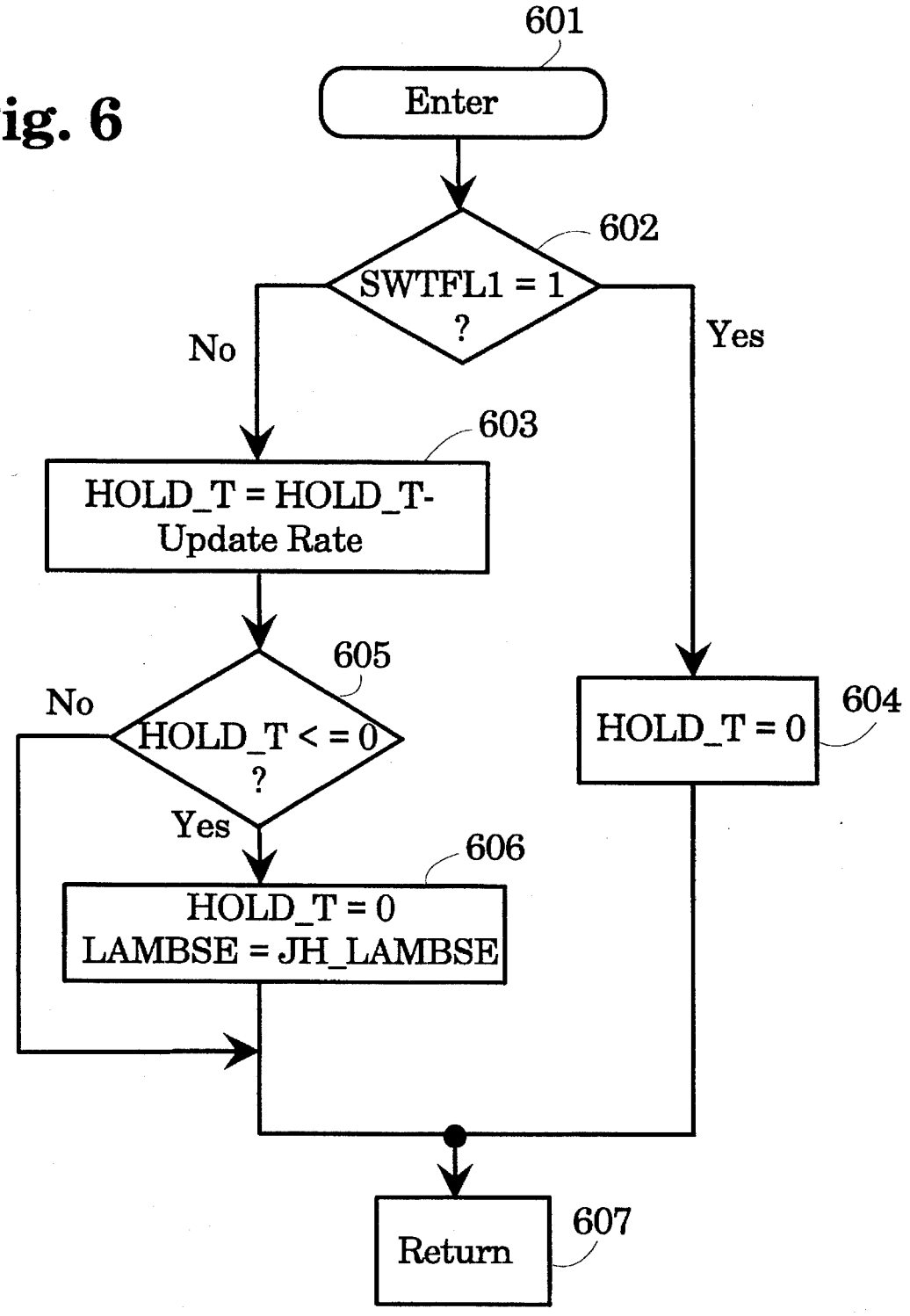

FIGS. 3, 4, 5 and 6 show the steps executed by a preferred embodiment to implement a jump-hold fuel control routine which generates the control signal LAMBSE to achieve a fuel delivery strategy of the type seen in FIGS. 2(*a*), 2(*b*) and 2(*c*). FIG. 3 shows the steps of the jump-hold fuel control routine, and FIGS. 4, 5 and 6 show steps of sub-routines called by the jump-hold routine of FIG. 3. The jump-hold routine of FIG. 3 is preferably executed as a portion of a closed-loop fuel control routine which is executed at fixed intervals.

The routine is entered at 301 and at steps 302–305 a flag designated as SWTFL1 is generated to provide an indication of whether the oxygen sensor has detected a change in the A/F ratio from rich to lean or lean to rich. The flag SWTFL1 is set to a value of zero at 304 if the oxygen sensor has not switched since the last execution of the jump-hold routine and to a value of one if the oxygen sensor has switched since the last execution of the jump-hold routine. The use of the term "switched" herein is understood to mean a signal from the oxygen sensor indicating a change in the oxygen content of the exhaust gas from a lean to rich A/F ratio or from a rich to lean A/F ratio. In order to generate a value for SWTFL1 at steps 304 and 305, at step 302 the current value of an oxygen sensor state flag EGOFL1 is stored in a temporary register designated as egofl1_old and a new value for EGOFL 1 is sampled. EGOFL1 preferably has a value of zero when the oxygen sensor indicates a lean condition and a value of one when the oxygen sensor indicates a rich condition.

At step 303, the value of EGOFL1 is compared to egofl1_old to determine if the oxygen sensor has switched states. If so, then at 305, SWTFL1 is set to a value of one, and otherwise SWTFL1 is set to a value of zero at step 304.

At step 306, variable HOLD_T which indicates whether or not the fuel flow rate should be maintained at its current level is tested. If HOLD_T equals zero then at 308 a hold routine is performed to maintain the current fuel flow rate. A value for variable HOLD_T is generated in a manner to be described in the description accompanying FIG. 6. At steps 307–311, if the hold period has expired, the fuel flow rate is either abruptly changed at step 311, or ramped at step 310, depending on the value of SWTFL1 at step 309.

First, at step 307 values for the variables, PTPAMP, BIAS_G and TD_SEC, are generated by retrieving the values from tables stored in a read only memory of the EEC. Each of the tables is preferably indexed by engine speed and engine load. A value for each of the variables is retrieved from a corresponding table by measuring the rotational speed of the engine, and the mass flow rate of air into the intake manifold. Index values for the tables are then generated from the measured engine speed and the calculated engine load in order to retrieve a corresponding value from the table. Values for the variables PTPAMP, BIAS_G and TD_SEC are preferably empirically determined to optimize catalytic converter efficiency over a range of engine speed and load points.

At step 309, the value of SWTFL1 is checked to determine if the oxygen sensor has changed from providing a rich indication to a lean indication or from a lean indication to a rich indication. If a change in the state of the oxygen sensor has occurred, then SWTFL1 will have a value of one, and at 311, the fuel flow rate will be abruptly altered by a jump value in a manner shown in FIG. 5. If a change in the state of the oxygen sensor has not occurred, then at step 310 the fuel delivery rate is abruptly changed to a rate corresponding to a stoichiometric ratio and is then progressively altered in a manner shown in FIG. 4. The jump-hold routine is then exited at step 312.

FIG. 4 shows the steps of a ramp subroutine, referenced at step 310 of FIG. 3, which is executed to progressively alter the fuel delivery rate. The routine is entered at step 401 and at step 402, a value of a variable delta_t is set equal to a constant Update_Rate, which is indicative of a predetermined rate at which the fuel control signal LAMBSE is to be updated. A value for a variable delta_lambse is then calculated according to the equation seen in step 402. The variable delta_lambse is indicative of an amount by which fuel control signal LAMBSE is changed. The value JFR is a scaling multiplier used to determine a change in LAMBSE as a function of the peak-to-peak amplitude value PTPAMP. In a preferred embodiment, JFR has a value of 0.5.

At step 403, the value of flag EGOFL1 is tested to determine whether the oxygen sensor is providing a rich indication or a lean indication. If the oxygen sensor is providing a lean indication, then EGOFL1 will have a value of zero and at step 404, the value of fuel control signal LAMBSE will be reduced by an amount equal to the value of delta_lambse to increase the fuel delivery rate. If the oxygen sensor is providing a rich indication, then EGOFL1 will have a value of one and at step 405, the value of fuel control signal LAMBSE will be increased by an amount equal to the value of delta_lambse to decrease the fuel delivery rate. The routine is then exited at step 406.

FIG. 5 shows the steps of a jump subroutine, referenced at step 311 of FIG. 3, which is executed to abruptly alter the fuel delivery rate. The routine is entered at step 501 and at step 502, a value for delta_lambse is calculated as a function of variables JFR and PTPAMP. At step 503, EGOFL1 is tested and if it is determined to equal zero then at step 504, values for variables JH_LAMBSE and lambse are calculated by subtracting delta_lambse from LAMBSE. Variables JH_LAMBSE and lambse are used to hold intermediate values of LAMBSE. If at step 503, EGOFL1 is determined to not equal zero, which corresponds to a rich indication, then at step 505, values for variables JH_LAMBSE and lambse are calculated by adding delta_lambse to LAMBSE.

At steps 506 and 507, the value of BIAS_G is tested to determine the amount of desired bias in the air/fuel ratio to be combusted. BIAS_G is a calibratable value which is stored in a table indexed by engine speed and engine load. In a preferred embodiment, BIAS_G may be calibrated to provide for different biases in the air/fuel mixture for different speed and load points. A calibration of BIAS_G to a value less than zero indicates a desired bias rich of stoichiometry, as is shown in FIGS. 2(*a*), 2(*b*) and 2(*c*). Conversely, a calibration of BIAS_G to a value greater than zero indicates a desired bias lean of stoichiometry.

If at 506, BIAS_G is not greater than zero, or if at 507, BIAS_G is not less than zero, then at step 512, LAMBSE will get set equal to the value lambse calculated at step 504 or 505. Thus at 506, if BIAS_G is not greater than zero, indicating a desired rich bias, then at 512, the fuel flow rate will be increased in order to make the air/fuel ratio richer. If at 507, if BIAS G is not less than zero, indicating a desired lean bias, then at 512, the fuel flow rate will be decreased in order to make the air/fuel ratio leaner.

At steps 508 and 509, a new value for the variable lambse is calculated by adding a bias jump value, which takes the form of Lean Bias Jump value (LBJ) at step 508 or a Rich Bias Jump value (RBJ) at step 509. An intermediate value, biasheight is then calculated as a function of the desired peak-to-peak amplitude, PTPAMP, and either LBJ, at step 508, or RBJ at step 509. The significance of the value biasheight is shown in FIGS. 2(*a*), 2(*b*) and 2(*c*). As can be seen in those figures, biasheight is indicative of the difference between the value of the fuel delivery signal LAMBSE at the jump value and the value of LAMBSE required to achieve a stoichiometric air/fuel ratio. The value biasheight is used at steps 510 and 511 to calculate a value for the variable HOLD_T, which as seen in FIGS. 2(*a*), 2(*b*) and 2(*c*) is the amount of time for which LAMBSE is maintained at the jump value.

At step 510, a value for a variable biasfraction is calculated by dividing biasheight by the absolute value of BIAS_G. A clipping function may also be performed to limit the hold time to a maximum amount. At step 511, a value for the variable HOLD_TIME is calculated according to the following relationship:

$$\text{HOLD_TIME} = \frac{2 * TDSEC}{\text{biasfraction} - 1}$$

Finally, at step 512, LAMBSE is set equal to the value of the variable lambse calculated either at steps 508 or 509 and the routine is exited.

FIG. 6 shows the steps of a hold subroutine, referenced at step 308 of FIG. 3, which is executed to maintain the fuel delivery rate. The routine is entered at step 601 and at step 602 the value of SWTFL1 is checked to determine if the oxygen sensor has changed from a rich state to a lean state or vice-versa. If so, i.e. SWTFL1 equals one, then at 604, HOLD_T is set to zero and the routine is exited. Thus, upon the subsequent execution of the jump hold routine of FIG. 3, the controller will respond to EGOFL1 by ramping. If at 602, SWTFL1 is found to not equal one, then at step 603, HOLD_T is decremented by the predetermined update rate value, Update_Rate. At step 605 HOLD_T is compared and if it found to be less than or equal to zero, meaning that the hold period has expired, then at 606, HOLD_T is set to zero, and LAMBSE is set equal to JH_LAMBSE which was calculated at steps 504 or 505 in FIG. 5. If at step 605, the hold time has not expired, then the fuel delivery rate is not changed and the routine is exited at step 607.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. In an internal combustion engine, which combusts an air/fuel mixture to generate an exhaust gas, a method for controlling the fuel delivery rate at which fuel is supplied to the fuel intake of the engine, to bias the average air/fuel mixture combusted by the engine by a variable amount in a first direction from stoichiometry, the method comprising the steps of:

measuring the amount of oxygen in the combustion gases exhausted by said engine to produce a first exhaust indication when said oxygen level indicates a ratio of air to fuel in said air/fuel mixture which is in said first direction from stoichiometry and to produce a second exhaust indication when said oxygen level indicates a ratio of air to fuel in said air/fuel mixture gas which is in a second direction from stoichiometry, said second direction being opposite from said first direction;

responding to said first exhaust indication by abruptly altering the fuel delivery rate to a rate which produces a ratio of air to fuel in said air/fuel mixture which is substantially equal to a predetermined air/fuel ratio, and thereafter progressively altering the fuel delivery rate to gradually change the ratio of air to fuel in said air/fuel mixture in said second direction from stoichiometry; and responding to said second exhaust indication by altering the fuel delivery rate by a jump value, maintaining said fuel delivery rate for a hold time, abruptly altering the fuel delivery rate to a rate which produces a ratio of air to fuel in said air/fuel mixture which is substantially equal to said predetermined air/fuel ratio, and thereafter progressively altering the fuel delivery rate to gradually change the ratio of air to fuel in said air/fuel mixture in said first direction from stoichiometry.

2. The method as set forth in claim 1 wherein said first direction corresponds to a ratio of air to fuel which is rich of stoichiometry and said second direction corresponds to a ratio of air to fuel which is lean of stoichiometry.

3. The method as set forth in claim 1 wherein said first direction corresponds to a ratio of air to fuel which is lean of stoichiometry and said second direction corresponds to a ratio of air to fuel which is rich of stoichiometry.

4. The method as set forth in claim 1 wherein said jump value equals zero.

5. The method as set forth in claim 1 wherein said jump value equals a value which causes said fuel delivery rate to be changed in a direction which is closer to stoichiometry.

6. The method as set forth in claim 1 wherein said jump value equals a value which causes said fuel delivery rate to be changed in a direction which is further from stoichiometry.

7. The method as set forth in claim 5 wherein said first direction corresponds to a ratio of air to fuel which is rich of stoichiometry and said second direction corresponds to a ratio of air to fuel which is lean of stoichiometry.

8. The method as set forth in claim 6 wherein said first direction corresponds to a ratio of air to fuel which is lean of stoichiometry and said second direction corresponds to a ratio of air to fuel which is rich of stoichiometry.

9. The method as set forth in claim 5 wherein said jump value is determined by:

generating an engine speed value indicative of the rotational speed of the engine;

generating an engine load value indicative of engine load; and generating said jump value as a function of said engine speed value and said engine load value.

10. The method as set forth in claim 9 wherein said hold time is generated as a function of said engine speed value and said engine load value.

11. The method as set forth in claim 6 wherein said jump value is determined by:

generating an engine speed value indicative of the rotational speed of the engine;

generating an engine load value indicative of engine load; and generating said jump value as a function of said engine speed value and said engine load value.

12. The method as set forth in claim 11 wherein said hold time is generated as a function of said engine speed value and said engine load value.

13. In an internal combustion engine, which combusts an air/fuel mixture to generate an exhaust gas, an electronic engine controller for controlling the fuel delivery rate at which fuel is supplied to the fuel intake of the engine, comprising:

first means, responsive to an oxygen sensor which detects the oxygen content of said exhaust gas, for producing a rich indication when said oxygen level is low and for producing a lean indication when said oxygen level is high;

second means, responsive to said first means, for reducing the Nox emissions of the engine comprising means, responsive to said lean indication, for abruptly increasing the fuel delivery rate to a first rate which corresponds to a predetermined fuel delivery rate, thereafter gradually increasing the fuel delivery rate, and means, responsive to said rich indication, for abruptly decreasing said fuel delivery rate by a jump value and for thereafter maintaining the fuel delivery rate for a hold time, and at the expiration of said hold time, abruptly decreasing the fuel delivery rate to said first rate and thereafter, gradually decreasing the fuel delivery rate.

14. The invention as set forth in claim 13 further comprising:

third means, responsive to said first means, for reducing the hydrocarbon and carbon monoxide emissions of the engine comprising means, responsive to said lean indication, for abruptly increasing the fuel delivery rate to a first rate which corresponds to said predetermined fuel delivery rate, thereafter gradually increasing the fuel delivery rate, and means, responsive to said rich indication, for maintaining the fuel delivery rate for a hold time, and at the expiration of said hold time, abruptly decreasing the fuel delivery rate to said first rate and thereafter, gradually decreasing the fuel delivery rate.

15. The invention as set forth in claim 14 further comprising:

fourth means, responsive to said first means, for adjusting the fuel flow rate in a manner to compensate for a fuel other than gasoline comprising means, responsive to said lean indication, for abruptly increasing the fuel delivery rate to a first rate which corresponds to said predetermined fuel delivery rate, thereafter gradually increasing the fuel delivery rate, and means, responsive to said rich indication, for abruptly increasing said fuel delivery rate by a jump value, and maintaining the fuel delivery rate for a hold time, and at the expiration of said hold time, abruptly decreasing the fuel delivery rate to said first rate and thereafter, gradually decreasing the fuel delivery rate.

16. The invention as set forth in claim 15 further comprising:

means for generating an engine speed value indicative of the rotational speed of the engine;

means for generating an engine load value indicative of engine load; and means, responsive to said engine speed value and said engine load value, for generating said jump value.

17. The method as set forth in claim 16 further comprising, means, responsive to said engine speed value and to said engine load value, for generating said hold time.

* * * * *